US006862778B2

(12) United States Patent
Sosa

(10) Patent No.: US 6,862,778 B2
(45) Date of Patent: Mar. 8, 2005

(54) SELF-SUPPORTING DEVICE TO HINGE TOWARD OPPOSITE SIDES

(76) Inventor: Amilcar Félix Sosa, Tucumán 3474, 3° "11", Ciudad de Buenos Aires (AR), 1189

( * ) Notice: Subject to any disclaimer, the term of this patent is extended or adjusted under 35 U.S.C. 154(b) by 0 days.

(21) Appl. No.: 10/244,976

(22) Filed: Sep. 16, 2002

(65) Prior Publication Data

US 2003/0051407 A1 Mar. 20, 2003

(30) Foreign Application Priority Data

Sep. 19, 2001 (AR) ..... P010104418

(51) Int. Cl.[7] ..... E05D 3/06
(52) U.S. Cl. ..... 16/221; 16/366; 49/193
(58) Field of Search ..... 16/221, DIG. 29, 16/388, 382, 387, 366, 320, 346, 390, 391; 49/382, 381, 397, 402, 398, 399, 193

(56) References Cited

U.S. PATENT DOCUMENTS 3,290,719 A * 12/1966 Courson ..... 16/231
3,889,419 A * 6/1975 Maleck ..... 49/193
4,063,330 A * 12/1977 Triplette ..... 16/321
4,132,034 A 1/1979 Van Siclen
4,158,271 A * 6/1979 Barry ..... 49/386
4,222,149 A * 9/1980 Holbek ..... 16/232
4,414,706 A * 11/1983 Douglas ..... 16/370
4,727,621 A * 3/1988 Emery et al. ..... 16/239
5,067,625 A 11/1991 Numata
5,148,629 A 9/1992 Minami
5,423,149 A * 6/1995 Herbst ..... 49/382
5,473,841 A * 12/1995 Grillo ..... 49/394
5,548,927 A * 8/1996 Song ..... 49/193
5,675,934 A * 10/1997 Park ..... 49/193
5,860,554 A * 1/1999 Ruffo ..... 220/832
6,138,325 A * 10/2000 Figliola et al. ..... 16/382
6,269,520 B1 * 8/2001 Kovalchek ..... 16/221
6,401,393 B2 6/2002 Juntunen

* cited by examiner

*Primary Examiner*—Gary Estremsky
*Assistant Examiner*—Mark Williams
(74) *Attorney, Agent, or Firm*—Emrich & Dithmar LLC

(57) ABSTRACT

A self-supporting hinge assembly structurally arranged to provide a hinge on the opposite edges of a door or closure member is disclosed. The hinge assembly includes a pair of support members, one support member being mounted to the container frame and the other support member being mounted to the inside surface of the container door or closure and a pair of closing arm members positioned within the pair of support members. The ends of the closing arm members are selectively and pivotally mounted to the ends of the support members.

12 Claims, 4 Drawing Sheets

FIG. 4
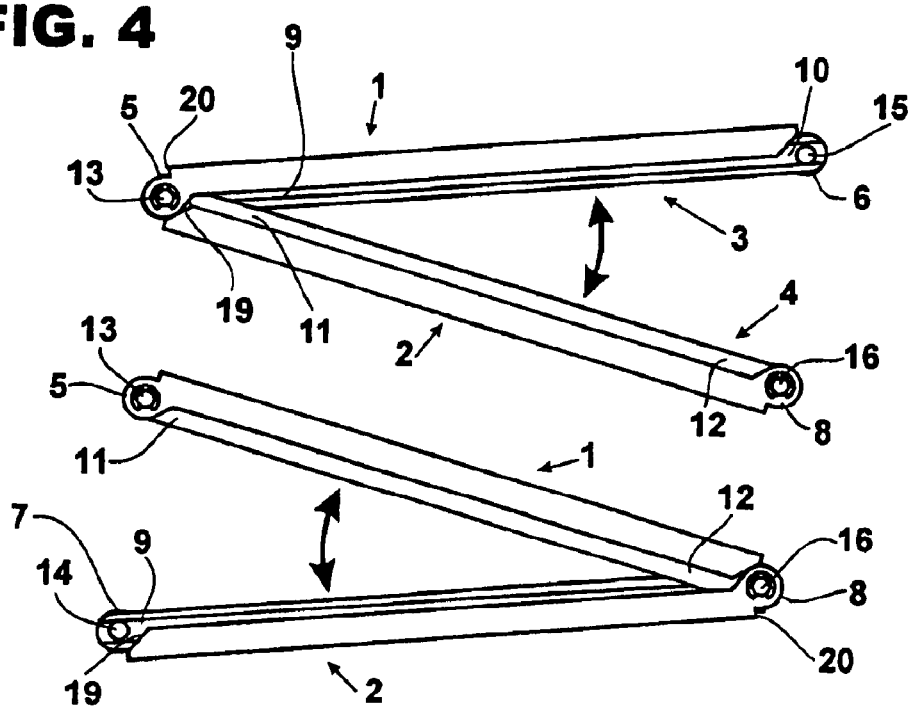
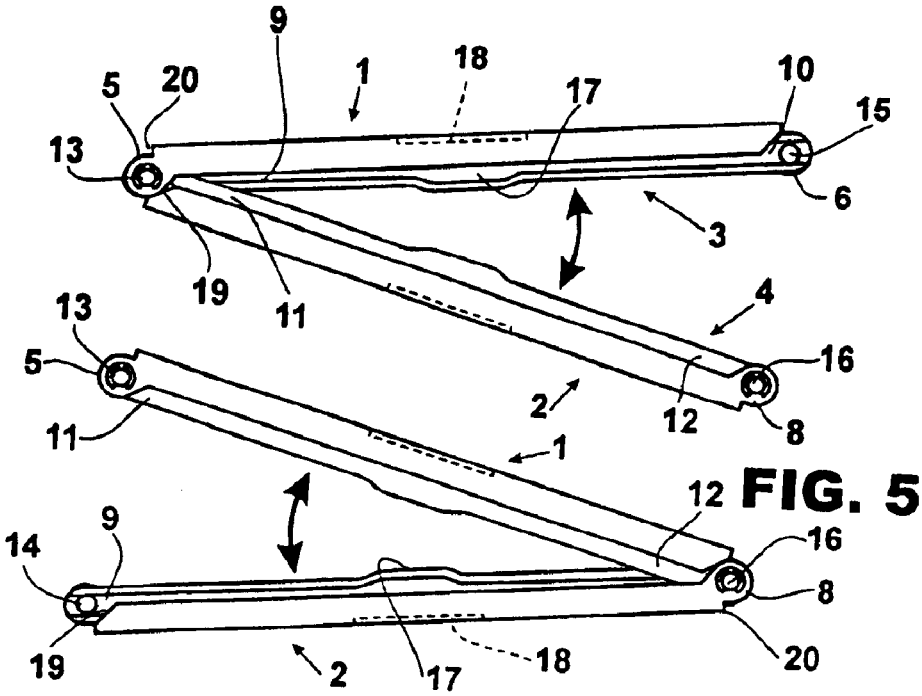
FIG. 5

SELF-SUPPORTING DEVICE TO HINGE TOWARD OPPOSITE SIDES

BACKGROUND OF THE INVENTION

The present invention relates to a hinge assembly structurally arranged to provide a hinge on the vertical edges of a door or closure member which includes an integrated set of members articulated and pivotally mounted in a linkage manner the frame of the housing or container to the door or closure member.

DESCRIPTION OF PRIOR ART

Hinge assemblies for opening closures or doors on opposite sides of a framed opening are well known. Such devices include doors as well as different types of lids, covers or other types of closures. For example, U.S. Pat. No. 4,132,034 relates to a refrigerator door with a strap hinge assembly which alternatively permits the door to be hinged from opposite vertical edges of the door. Such hinge assemblies consist of separate pairs of hinge assemblies which include hinges at their ends and which act in a complementary manner. Accordingly, the hinge assembly consists of two sets of hinges that must be assembled and mounted to the frame, thereby occupying much space with the assembly composed of at least six separate members plus the shafts for mounting the hinge assemblies. Alternatively, U.S. Pat. No. 5,067,625 relates to a hinge assembly for opening and closing a box lid, such as a lid used on a console box between the front seats in an automobile. Such a hinge assembly includes a pair of articulated arms wherein one of the articulated arms is directly mounted on the closure or door and on the edges of the console box and the other articulated arm is mounted onto the frame of the box on which the closure or door is mounted. Accordingly, such hinge assemblies are mounted on the lid as well as the frame or edge of the console box. Thus, the structure of the box itself must be modified to accept the several pieces of the hinge assembly to permit the door to open on the side edges of the closure or door.

SUMMARY OF THE INVENTION

The present invention relates to a hinge assembly which is structurally arranged to have a portion thereof mounted to the frame surrounding the opening on a cabinet or container and a portion structurally arranged to be mounted to the closure or door member, such that the closure or door member may be hingedly opened on opposite edges of the closure or door, as desired. The hinge assembly includes two support members which act as linkage means between the frame of the cabinet or container opening and the closure or door member engaging the frame of the container. The hinge assembly further includes two opening and closing arm members whose ends provide articulated connection with the opposite ends of the support members. The hinge assembly may be readily and structurally arranged to be mounted to any framed enclosure or container and any door or closure member to pivotally enclose the enclosed structure. Each of the support members is U-shaped in cross section and defines a recess therein. When the door member is in the closed position, the complimenting and collapsed support members abut one another and provide a recess therein. The pair of opening and closing arm members are positioned within the cavity with the ends of the pair of opening and closing arm members being selectively and pivotally mounted to opposite ends of the support members to thereby permit the door or closure to be hingedly opened and closed from each side thereof.

The hinge assembly is self-supporting and may be fixed to any type of closure or door member which is structurally arranged to cooperate with the frame about the opening of the enclosed box, cabinet or enclosure. The hinge assembly is specially adaptable for attachment to closures or door members used in furniture, kitchens, bathrooms, cabinets, refrigerators, boxes or containers and window sashes. The compactness of the hinge assembly in accordance with the present invention and the associated support members permit fixation to any location while occupying a minimum amount of space with respect to the attached frame of the enclosure and the door or closure member.

The present invention consists of certain novel features and structural details hereinafter fully described, illustrated in the accompanying drawings, and particularly pointed out in the appended claims, it being understood that various changes in the details may be made without departing from the spirit or sacrifice any of the advantages of the present invention.

DESCRIPTION OF THE DRAWINGS

For the purpose of facilitating an understanding of the present invention, there is illustrated in the accompanying drawings a preferred embodiment of the present invention, from an inspection of which, when considered in connection with the following description, the invention, its construction and operation and many of its advantages may be readily understood and appreciated.

FIG. 4 is a top plan view of the hinge assembly in accordance with the present invention, with the upper view corresponding to the opening of the closure with respect to the cabinet on the right side of the cabinet (not shown), and the lower view corresponding to the opening of the closure on the left side of the cabinet (not shown);

FIG. 5 is a top plan view illustrating a further embodiment of the present invention which is provided with magnetic closing members of the hinge assembly as shown in FIG. 4;

In the various drawings, the same reference numerals have been used throughout the several views to indicate equal or corresponding parts.

REFERENCE NUMERALS IN THE DRAWINGS

1. First Support Member
2. Second Support Member
3. First Arm Member
4. Second Arm Member
5. First End of First Support Member
6. Second End of First Support Member
7. Third End of Second Support Member
8. Fourth End of Second Support Member
9. Fifth End of First Arm Member
10. Sixth End of First Arm Member
11. Seventh End of Second Arm member
12. Eighth End of Second Arm Member
13. First Hinge Pin
14. Second Hinge Pin
15. Third Hinge Pin
16. Fourth Hinge Pin
17. Flange of the Magnetic Closure
18. Magnetic Means
19. Gap or Recess
20. Opening Stop
21. Fixation Holes
22. Fixation Screws
23. Articulation Holes adapted to receive the hinge pin 13, 14, 15 and 16
24. Opposite lateral walls of the Supports 1 and 2
25. Primary Wall of the Supports 1 and 2

DESCRIPTION OF THE EMBODIMENT

Figure 1:
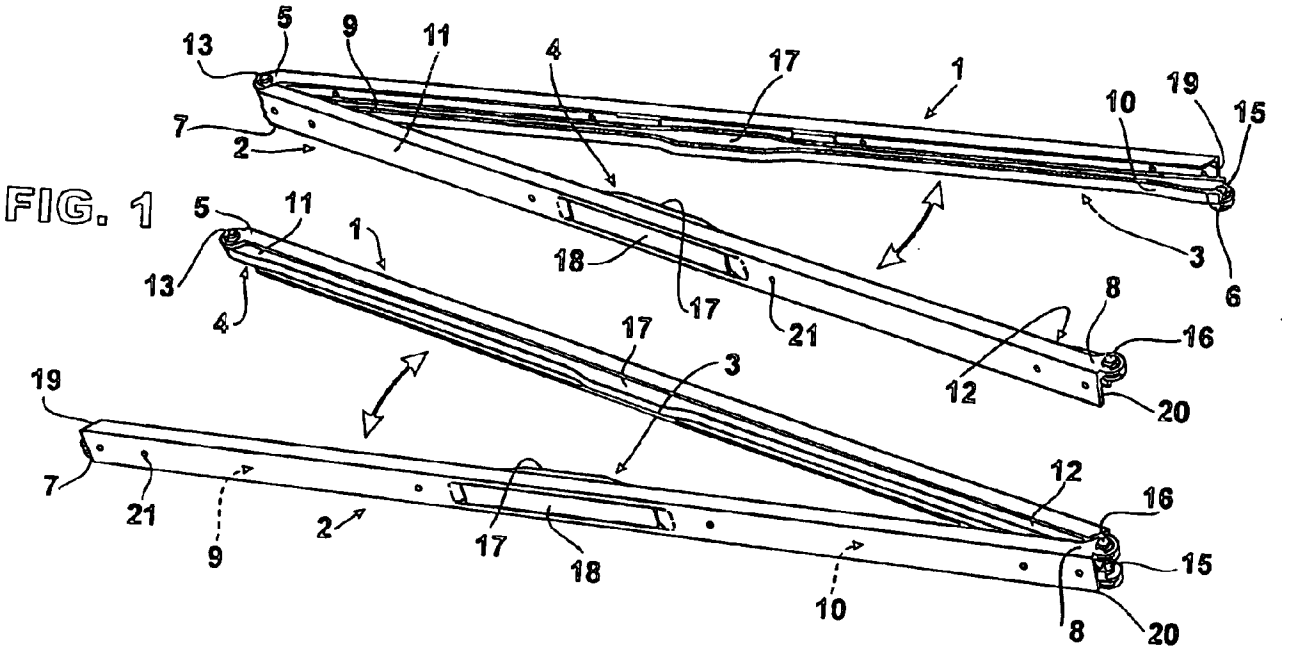
FIG. 1 is a perspective view of the hinge assembly, the upper view corresponding to the opening on one side of the hinge assembly, and the lower view corresponding to an opening on the opposite side of the hinge assembly in accordance with the present invention.

The present invention relates to a self-supporting hinge assembly structurally arranged to hinge a door or closure member (not shown) on opposite edges of the door or closure member. In FIG. 1, the hinge assembly includes two support members 1 and 2 which act as a linkage between the frame of the container or box (not shown) and the closure or door member and two opening and closing arm members 3 and 4 (FIGS. 1 and 3) whose ends 9–12 are selectively and pivotally mounted to provide articulated connections 13–16 with the opposite ends 5–8 of support members 1 and 2.

Figure 2:
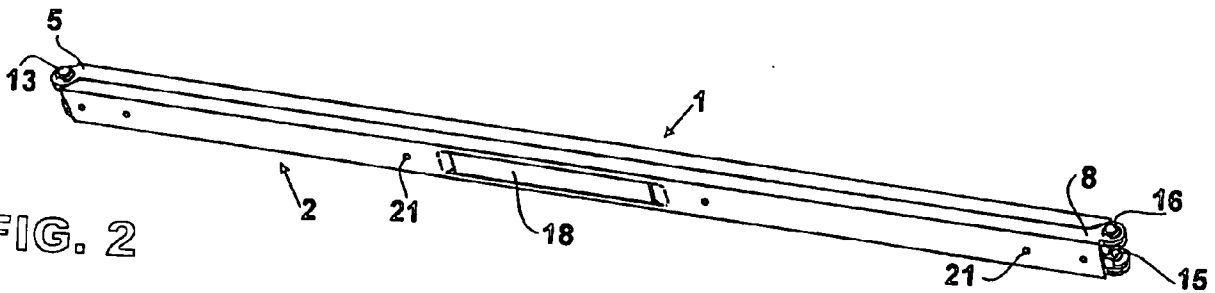
FIG. 2 is a perspective view of the closed and collapsed hinge assembly, illustrating the compactness of the assembly in accordance with the present invention.
Figure 3:
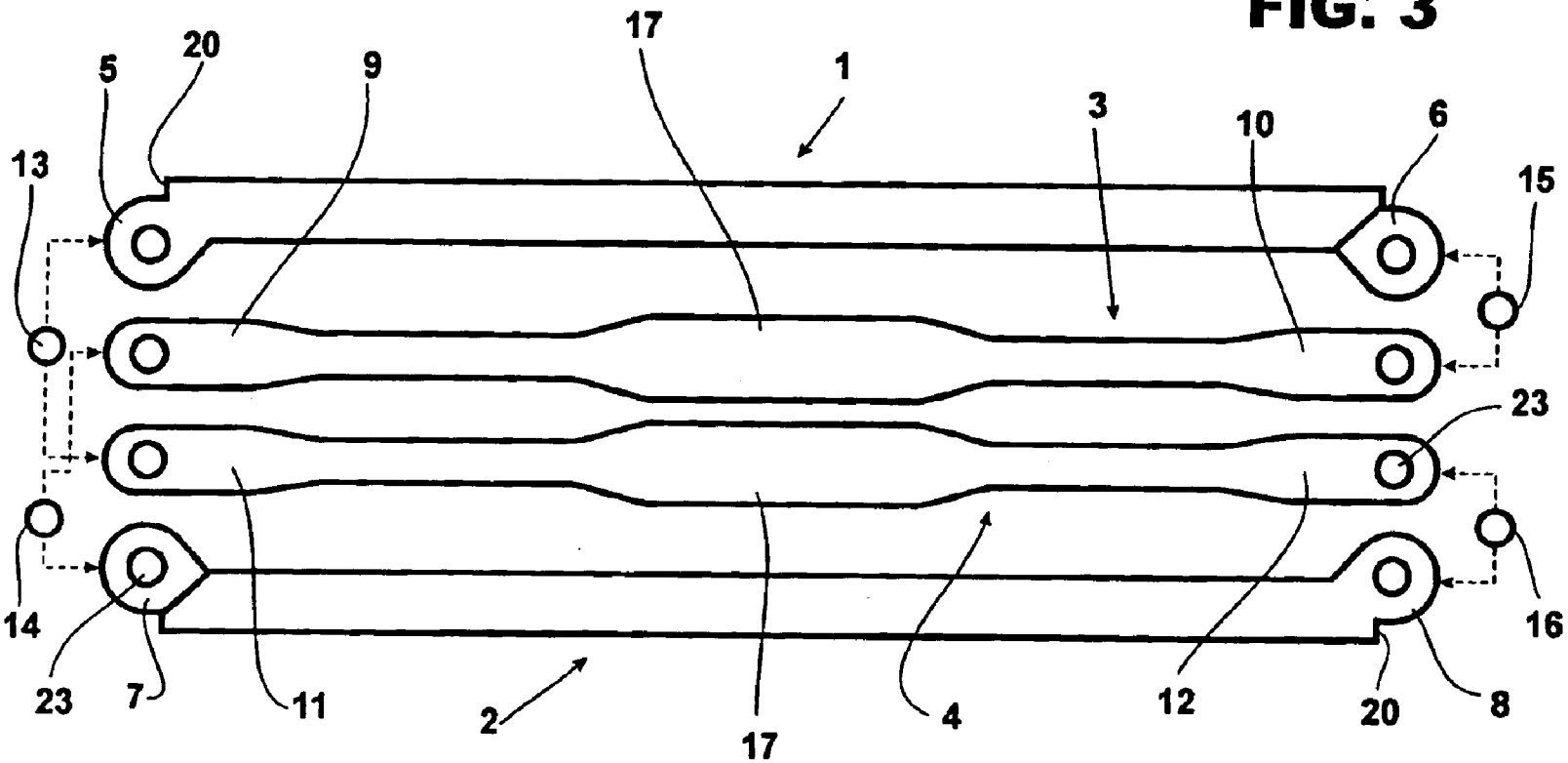
FIG. 3 is a top plan view of the parts or elements of the hinge assembly, wherein the broken lines indicate how the ends of the elements are linked together by means of the hinge pins in accordance with the present invention.
Figure 6:
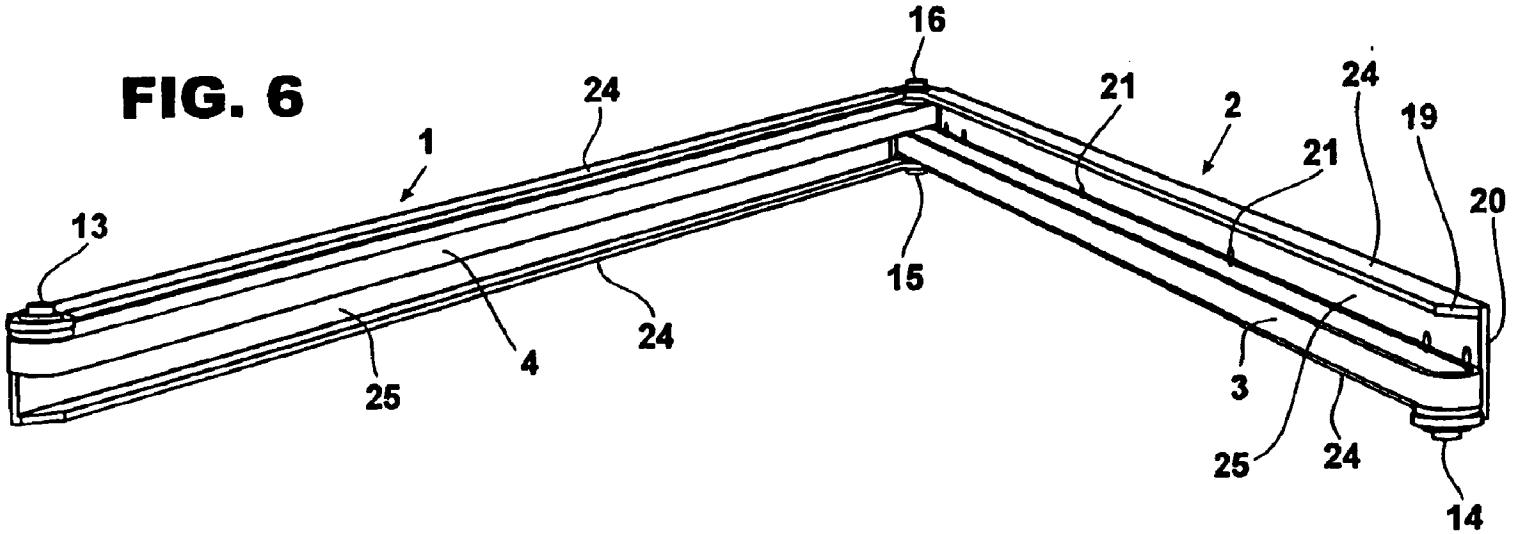
FIG. 6 is a perspective view of the hinge assembly which illustrates the relationship between the first and second support members and the first and second arm members when the door member is hinged on the left side of the door member.

As shown in FIGS. 1,3 and 6, the hinge assembly or device includes a first support member 1 and a second support member 2 that, in the embodiments shown, each have a U-shaped cross-section and define a recess therein, as shown by lateral walls 24 and primary wall 25. As shown in FIG. 2, both support members 1 and 2 complement each other and are engaging each other when the hinge assembly moves the door member to the closed position. When support members 1 and 2 are in the closed position, a channel or recess extending the length of the support members 1 and 2 is provided and is structurally arranged to receive the two opening and closing arm members 3 and 4. Each support member 1 and 2 is symmetrically alike, and each possesses upper and lower sides of lateral walls 24 connected by primary wall 25 and each include an articulation mounting bracket and hole 23 at the end thereof.

Specifically, the hinge assembly in accordance with the present invention includes a first support member 1 having a first end 5 and a second end 6 and a support member 2 having a third end 7 and a fourth end 8. Support members 1 and 2 are mounted together such that the first end 5 of support member 1 and the third end 7 of support member 2 remain on one side of the hinge assembly, and the second end 6 of the first support member and the fourth end 8 of the support member 2 remain on the opposite side of the closure or frame (not shown). As is clear from FIG. 3, the two arm members 3 and 4 are provided with openings 23 therein, with the first arm member 3 having a fifth end 9 and a sixth end 10, and the second arm member 4 having a seventh end 11 and eighth end 12. The hinge assembly mechanism is completed when the arm members and support members are arranged and secured together. This is accomplished by securing the sixth end 10 of the first arm member 3 to end 6 of support member with element 15 and the eighth end 12 of the arm member 4 to fourth end 8 of support member 2 to remain on one side of the hinge assembly and the fifth end 9 and the seventh end 11 remain on the opposite side of the hinge assembly.

The two support members 1 and 2 and the two arm members 3 and 4 form a linkage or articulated connection when they are operatively connected together. As shown in FIG. 3, the articulated connections are integrated together through articulation holes 23 by pins 13–16, accordingly. Specifically, the first end 5 of support member 1 is linked by means of pin or element 13 to the seventh end 11 of the second arm member 4. The eighth end 12 of the second arm member 4 is linked by means of a fourth pin or element 16 through fourth end 8 of the second support member 2. The third end 7 of the second support member 2 is linked by means of a second pin element 14 to the fifth end 9 of the first arm member 3. The hinge assembly is completed when the sixth end 10 of the second arm member 3 is linked by means of pin or element 15 to the second end 6 of the first support member 1.

Also, as shown in FIGS. 4 and 5, each support member 1 and 2 and the lateral wall 24 opposite the joint wall define and form a gap or recess 19 which permits the free motion of the completed hinge assembly. Additionally, as shown in FIG. 6, the primary wall 25 of each support member 1 and 2 at the end where the gap or recess 19 ends forms an opening stop projection 20 for providing a stop for the movement of the support member.

Figure 7:
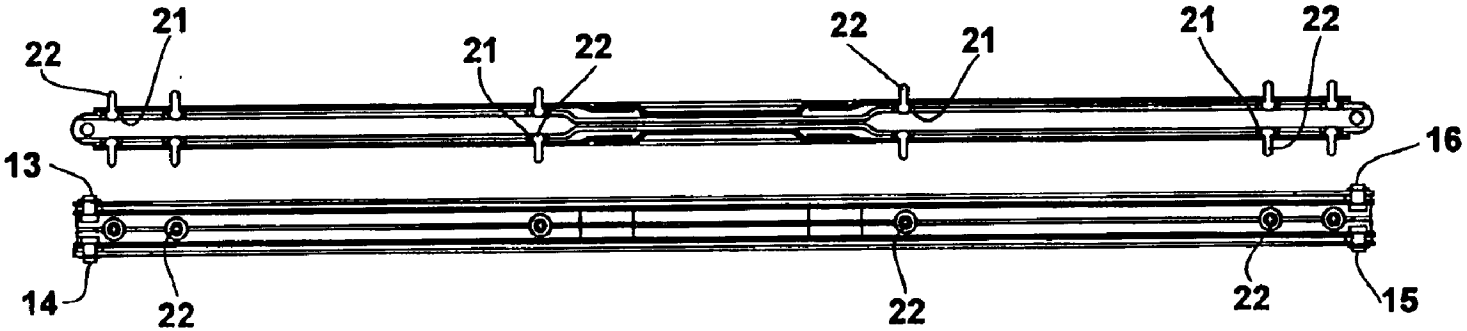
FIG. 7 is an enclosed hinge assembly in accordance with the present invention, wherein the upper drawing illustrates a longitudinal section taken along the horizontal plane of the hinge assembly, and the lower drawing illustrates a longitudinal section taken along a vertical plane of the hinge assembly.

FIGS. 6 and 7 illustrate that on the primary walls 25 of support members 1 and 2, a plurality of fixation holes 21 and fixation screws or elements 22 have been provided. In the present embodiments of the hinge assembly, the fixation holes 21 cooperate with the respective screws or elements 22 to mount the support arms to the door or to the frame of the container, as desired. The support members 1 and 2 and the arm members 3 and 4 may be of the same length, but it is preferred that the distance which separates the fixation holes 21 on the opposite ends of each of the support members 1 and 2, as well as the arm members 3 and 4 should be the same.

Other embodiments of the present invention have been provided in that the support members 1 and 2 may include magnetic elements or members 18, as shown in FIG. 5, mounted to the primary wall 25. The magnetic members 18 faces the closing flange 17 of the arm support members 3 and 4 so that they can act as a closure to maintain the door or closure member in the closed position about the frame of the container.

For operation of the hinge assembly, the first support member 1 is mounted to the frame of the opening of the container or box. When the hinge assembly is to be opened by moving the third end 7 of the support member 2 away from the first end 5 of support member 1, the view shown in the lower view of FIG. 1, the second support member 2 is moved along with the first arm member 3, which is linked by means of second pin 14 to the third end 7 of the second support member 2. In conjunction with this movement, the second support member 2 articulates on the fourth hinge pin 16 and the first arm member 3 articulates on the third pin 15.

This permits the door or closure to which the second support member is mounted to be placed in the open position. If the device is to be positioned in the closed position, the hinge assembly is opened on the opposite side of the hinge assembly, and the fourth end 8 of the second support member 2 is moved along with the second arm member 4 away from the second end 6 of the first support member 1. During this movement, the second support member 2 articulates on the second pin 14, and the second arm articulates and pivots on the first pin 13. Therefore, the linkage of articulated connections 13–16 and the alternating opening of the closure or door from one side to the other is possible, as desired.

What is claimed is:

1. A hinge assembly to provide a mounting linkage for the bidirectional opening and a closing door member, which is structurally arranged to cooperate with a frame about an opening in a container housing, including in combination:

at least two support members each having ends thereon to provide a mounting linkage between the container frame and the door member, with one support member being mounted to the frame of the container and the other support member being mounted to the inside surface of the door member; with said first support member having first and second ends and said second support member having a third and fourth ends structurally arranged with respect to one another on the container and the door so that said first and third ends are adapted to pivot together and said second and fourth ends are adapted to pivot together;

at least two arm members operatively associated with said at least two support members, with said first arm member having a fifth and sixth ends and said second arm member having seventh and eighth ends structurally arranged so that said sixth and eighth ends remain on one side and said fifth and seventh ends remain on the opposite side when said arm members are positioned in the assembly, and wherein each of said respective arm members are pivotally connected to selected ends of said support members to provide a bidirectional connection therewith; and wherein said ends of each of said support members are pivotally mounted to said opposite ends of different arm members and said support and said arm members provide a linkage of a bidirectional connection linked with said first end of said support member having a bidirectional connection with said adjacent agent seventh end of said second arm member, said eighth end of said second arm member having a bidirectional connection with said adjacent fourth end of said second support member, said third end of said second support member having a bidirectional connection with said adjacent fifth end of said first arm member and said sixth end of said first arm member having a bidirectional connection with said adjacent end of said support member.

2. The hinge assembly in accordance with claim 1, wherein said ends of said support members are symmetrically inverse so that on one end they form a first bidirectional connection on a lateral wail and on the other end they form a second bidirectional connection on the opposite lateral wall.

3. The hinge assembly in accordance with claim 2, wherein each of said support members provide a channel between the lateral walls opposite the lateral walls.

4. The hinge assembly in accordance with claim 1, wherein each support member adjacent the ends thereof includes a stop thereon to stop the pivotal movement of said support members with respect to one another.

5. The hinge assembly in accordance with claim 1, wherein each of said support members are U-shaped in cross-section and that when they are in the closed position they complement each other and provide the formation of a cavity that is structurally adapted to receive said arm members.

6. The hinge assembly in accordance with claim 1, wherein each of said support members have fixation means to secure the support members to the frame and the door member, respectively.

7. The hinge assembly in accordance with claim 6, wherein the fixation means consist of openings structurally arranged to receive screw members.

8. The hinge assembly in accordance with claim 1, wherein the hinge assembly further includes closure restraining means consisting of magnetic members associated with said support members and cooperating with said arm members to secure the door member in the closed position.

9. The hinge assembly in accordance with claim 1, wherein said at least two support members and said at least two arm members are bidirectionally mounted to each other through four hinge pins.

10. The hinge assembly in accordance with claim 9, wherein said four hinge pins include a first pin linking said first end of one of said support members with said seventh end of said second arm member, a second pin linking said third end of said second support member with said fifth end of said first arm member, a third pin linking said second end of said first support member with the sixth end of said first arm member, and a fourth pin linking said fourth end of said second support member to said eighth end of said second arm member.

11. The hinge assembly in accordance with claim 1, wherein said support members and said arm members are of the same length.

12. The hinge assembly in accordance with claim 1, wherein the mounting linkage between the bidirectional connection on opposite ends is the same for said support members and said arm members.

* * * * *